US009653059B2

(12) United States Patent
Dejima

(10) Patent No.: US 9,653,059 B2
(45) Date of Patent: May 16, 2017

(54) MUSICAL SOUND CONTROL DEVICE, MUSICAL SOUND CONTROL METHOD, AND STORAGE MEDIUM

(71) Applicant: CASIO COMPUTER CO., LTD., Shibuya-ku, Tokyo (JP)

(72) Inventor: Tatsuya Dejima, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/145,283

(22) Filed: Dec. 31, 2013

(65) Prior Publication Data

US 2014/0190336 A1 Jul. 10, 2014

(30) Foreign Application Priority Data

Jan. 8, 2013 (JP) ..... 2013-001420

(51) Int. Cl.

| | |
|---|---|
| ***G10H 1/06*** | (2006.01) |
| ***G10H 1/02*** | (2006.01) |
| ***G10H 3/18*** | (2006.01) |
| ***G10H 1/055*** | (2006.01) |
| ***G10H 3/12*** | (2006.01) |

(52) U.S. Cl.

CPC ..... *G10H 3/188* (2013.01); *G10H 1/0551* (2013.01); *G10H 3/125* (2013.01); *G10H 2220/301* (2013.01); *G10H 2250/235* (2013.01)

(58) Field of Classification Search

USPC ..... 84/622

See application file for complete search history.

(56) References Cited

U.S. PATENT DOCUMENTS

| | | | | |
|---|---|---|---|---|
| 3,813,473 A * | 5/1974 | Terymenko | G10H 3/24 | 84/702 |
| 4,041,783 A * | 8/1977 | Shimauchi | G10G 7/02 | 73/579 |
| 4,823,667 A * | 4/1989 | Deutsch | G10H 1/0066 | 84/736 |
| 5,024,134 A | 6/1991 | Uchiyama | | |

(Continued)

FOREIGN PATENT DOCUMENTS

| | | |
|---|---|---|
| CN | 102790932 A | 11/2012 |
| JP | 01279297 A | 11/1989 |
| JP | 3704851 B2 | 10/2005 |

OTHER PUBLICATIONS

Japanese Office Action (and English translation thereof) dated Oct. 25, 2016, issued in counterpart Japanese Application No. 2013-001420.

(Continued)

*Primary Examiner* — Christopher Uhlir
(74) *Attorney, Agent, or Firm* — Holtz, Holtz & Volek PC

(57) ABSTRACT

A CPU 41 acquires a string vibration signal in a case where a string picking operation is performed with respect to the stretched string 22, analyzes a frequency characteristic of the acquired string vibration signal, determines whether or not the analyzed frequency characteristic satisfies a predetermined condition, and changes a frequency characteristic of a musical sound generated in the connected sound source 45 depending on a case where it is determined that the predetermined condition is satisfied or determined that the predetermined condition is not satisfied.

9 Claims, 17 Drawing Sheets

(56) References Cited

U.S. PATENT DOCUMENTS

| | | | | | |
|---|---|---|---|---|---|
| 5,025,703 | A | * | 6/1991 | Iba et al. | 84/718 |
| 5,033,353 | A | * | 7/1991 | Fala | G10H 1/0066 84/72 |
| 5,990,408 | A | * | 11/1999 | Hasebe | G10H 1/0066 84/723 |
| 6,111,186 | A | * | 8/2000 | Krozack et al. | 84/736 |
| 2012/0294457 | A1 | | 11/2012 | Chapman et al. | |

OTHER PUBLICATIONS

Chinese Office Action (and English translation thereof) dated Mar. 31, 2016, issued in counterpart Chinese Application No. 201410051518.8.

* cited by examiner

MUSICAL SOUND CONTROL DEVICE, MUSICAL SOUND CONTROL METHOD, AND STORAGE MEDIUM

This application is based upon and claims the benefit of priority from the prior Japanese Patent Application No. 2013-1420, filed Jan. 8, 2013, and the entire contents of which are incorporated herein by reference.

BACKGROUND OF THE INVENTION

Field of the Invention

The present invention relates to a musical sound control device, a musical sound control method and a storage medium.

Related Art

A musical sound control device is conventionally known that produces tapping harmonics according to a state of a switch on a left-hand side (refer to Japanese Patent No. 3704851). This musical sound control device determines a pitch difference with respect to pitch specified by a pitch specification operator prior to pitch specified by a pitch specification operator having tapping detected by a tapping determination unit, and a harmonics generation unit determines whether or not the pitch difference is coincident with a predetermined pitch difference, thereby generating predetermined harmonics corresponding to the pitch difference.

However, in the musical sound control device of Japanese Patent No. 3704851, it is impossible to realize sound generation of a musical sound having a frequency characteristic with a less high frequency component of muting or the like by changing a frequency characteristic of a musical sound.

SUMMARY OF THE INVENTION

The present invention has been realized in consideration of this type of situation, and it is an object of the present invention to change a frequency characteristic of a musical sound so as to generate a musical sound with mute timbre having a frequency characteristic with a less high frequency component of muting or the like.

In order to achieve the above-mentioned object, a musical sound control device according to an aspect of the present invention includes:

an acquisition unit that acquires a string vibration signal in a case where a string picking operation is performed with respect to a stretched string;

an analysis unit that analyzes a frequency characteristic of the string vibration signal acquired by the acquisition unit;

a determination unit that determines whether or not the analyzed frequency characteristic satisfies a condition; and a change unit that changes a frequency characteristic of a musical sound generated in a sound source according to a determination result by the determination unit.

DETAILED DESCRIPTION OF THE INVENTION

Descriptions of embodiments of the present invention are given below, using the drawings.

Overview of Musical Sound Control Device 1

Figure 1:
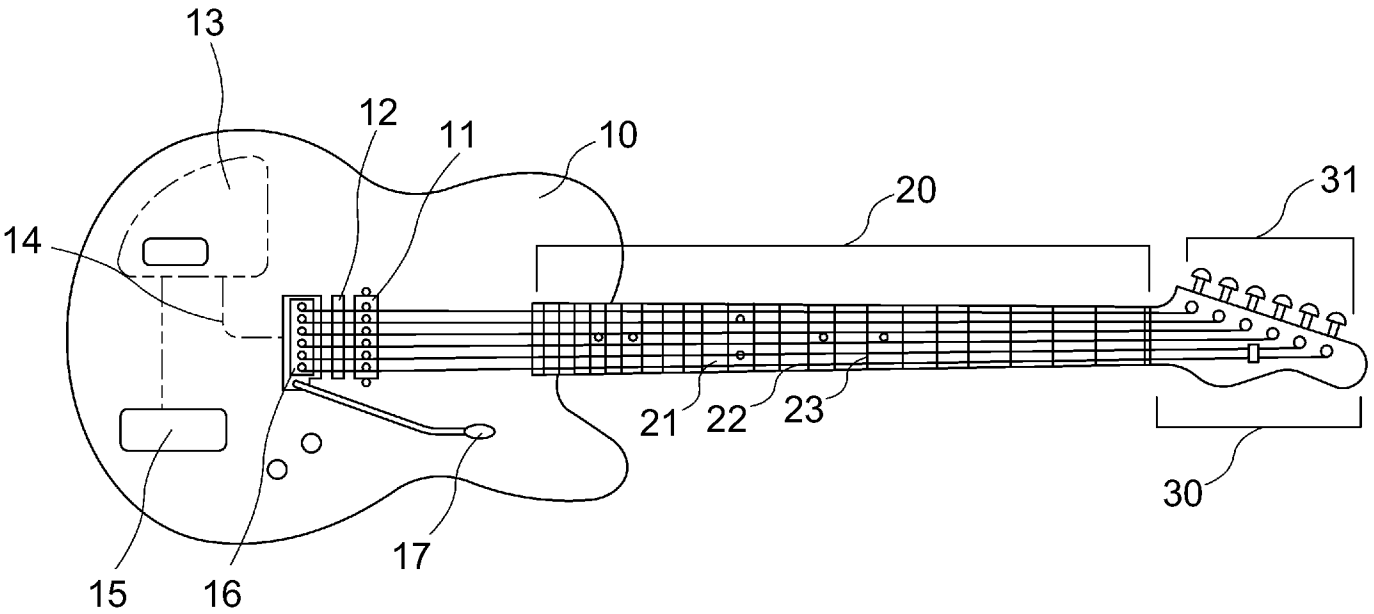
FIG. 1 is a front view showing an appearance of a musical sound control device of the present invention.

First, a description for an overview of a musical sound control device 1 as an embodiment of the present invention is given with reference to FIG. 1.

FIG. 1 is a front view showing an appearance of a musical sound control device. As shown in FIG. 1, the musical sound control device 1 is divided roughly into a body 10, a neck 20 and a head 30.

The head 30 has a threaded screw 31 mounted thereon for winding one end of a steel string 22, and the neck 20 has a fingerboard 21 with a plurality of frets 23 embedded therein. It is to be noted that in the present embodiment, provided are 6 pieces of the strings 22 and 22 pieces of the frets 23. 6 pieces of the strings 22 are associated with string numbers, respectively. The thinnest string 22 is numbered "1". The string number becomes higher in order that the string 22 becomes thicker. 22 pieces of the frets 23 are associated with fret numbers, respectively. The fret 23 closest to the head 30 is numbered "1" as the fret number. The fret number of the arranged fret 23 becomes higher as getting farther from the head 30 side.

The body 10 is provided with: a bridge 16 having the other end of the string 22 attached thereto; a normal pickup 11 that detects vibration of the string 22; a hex pickup 12 that independently detects vibration of each of the strings 22; a tremolo arm 17 for adding a tremolo effect to sound to be emitted; electronics 13 built into the body 10; a cable 14 that connects each of the strings 22 to the electronics 13; and a display unit 15 for displaying the type of timbre and the like.

Figure 2:
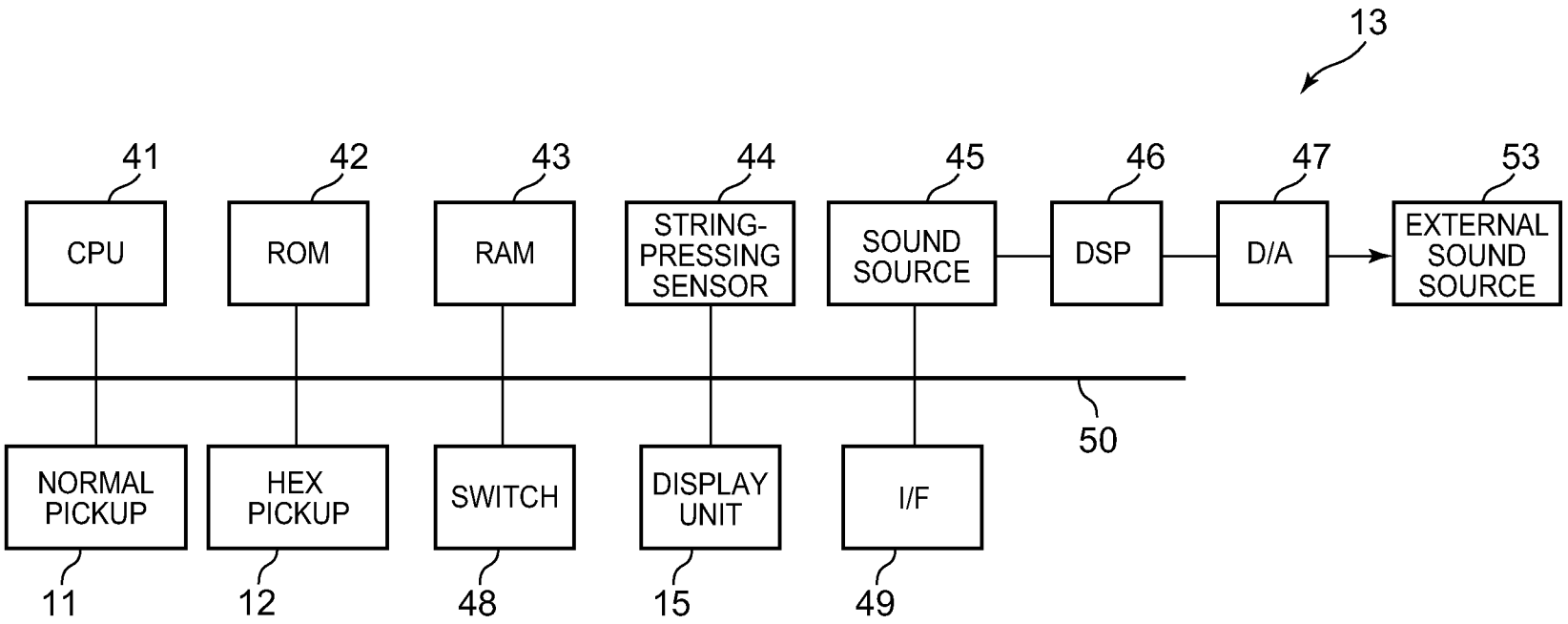
FIG. 2 is a block diagram showing an electronics hardware configuration constituting the above-described musical sound control device.

FIG. 2 is a block diagram showing a hardware configuration of the electronics 13. The electronics 13 have a CPU (Central Processing Unit) 41, a ROM (Read Only Memory) 42, a RAM (Random Access Memory) 43, a string-pressing sensor 44, a sound source 45, the normal pickup 11, a hex pickup 12, a switch 48, the display unit 15 and an I/F (interface) 49, which are connected via a bus 50 to one another.

Additionally, the electronics 13 include a DSP (Digital Signal Processor) 46 and a D/A (digital/analog converter) 47.

The CPU 41 executes various processing according to a program recorded in the ROM 42 or a program loaded into the RAM 43 from a storage unit (not shown in the drawing).

In the RAM 43, data and the like required for executing various processing by the CPU 41 are appropriately stored.

The string-pressing sensor 44 detects which number of the fret is pressed by which number of the string. The string-pressing sensor 44 includes the type for detecting electrical contact of the string 22 (refer to FIG. 1) with the fret 23 (refer to FIG. 1) to detect a string-pressing position, and the type for detecting a string-pressing position based on output from an electrostatic sensor described below.

The sound source 45 generates waveform data of a musical sound instructed to be generated, for example, through MIDI (Musical Instrument Digital Interface) data, and outputs an audio signal obtained by D/A converting the waveform data to an external sound source 53 via the DSP 46 and the D/A 47, thereby giving an instruction to generate and mute the sound. It is to be noted that the external sound source 53 includes an amplifier circuit (not shown in the drawing) for amplifying the audio signal output from the D/A 47 for outputting, and a speaker (not shown in the drawing) for emitting a musical sound by the audio signal input from the amplifier circuit.

The normal pickup 11 converts the detected vibration of the string 22 (refer to FIG. 1) to an electric signal, and outputs the electric signal to the CPU 41.

The hex pickup 12 converts the detected independent vibration of each of the strings 22 (refer to FIG. 1) to an electric signal, and outputs the electric signal to the CPU 41.

The switch 48 outputs to the CPU 41 an input signal from various switches (not shown in the drawing) mounted on the body 10 (refer to FIG. 1).

The display unit 15 displays the type of timbre and the like to be generated.

Figure 3:
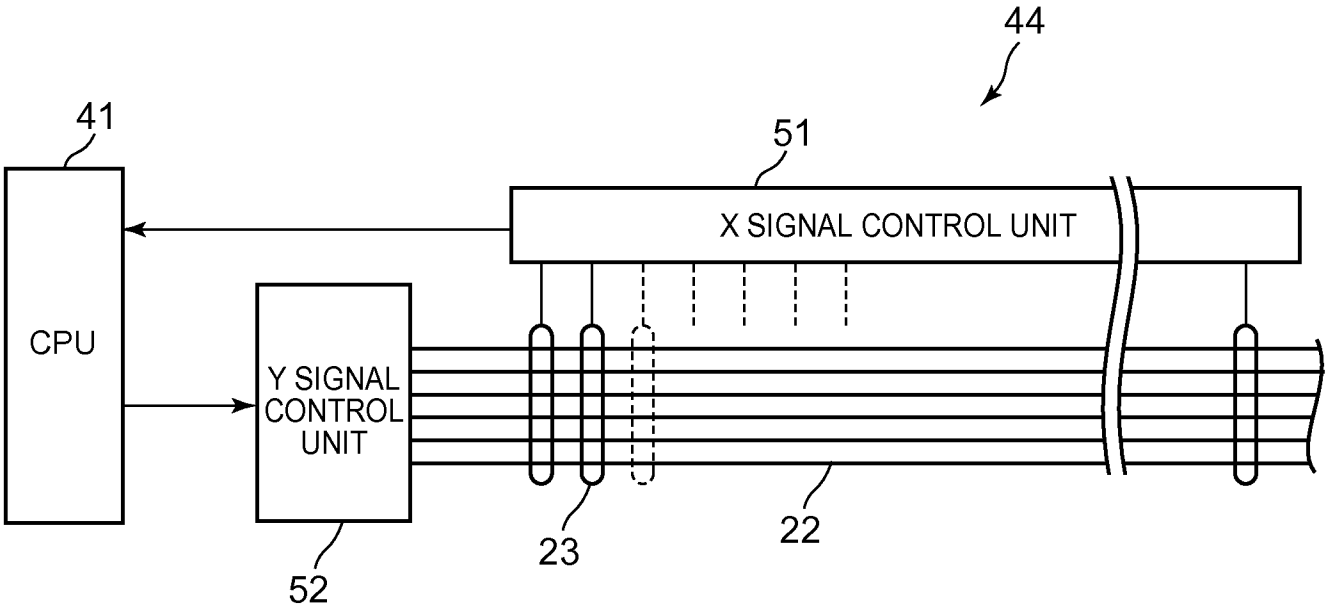
FIG. 3 is a schematic diagram showing a signal control unit of a string-pressing sensor.

FIG. 3 is a schematic diagram showing a signal control unit of the string-pressing sensor 44.

In the type of the string-pressing sensor 44 for detecting an electrical contact location of the string 22 with the fret 23 as a string-pressing position, a Y signal control unit 52 supplies a signal received from the CPU 41 to each of the strings 22. An X signal control unit 51 outputs, in response to reception of a signal supplied to each of the strings 22 in each of the frets 23 by time division, a fret number of the fret 23 in electrical contact with each of the strings 22 to the CPU 41 (refer to FIG. 2) together with the number of the string in contact therewith, as string-pressing position information.

In the type of the string-pressing sensor 44 for detecting a string-pressing position based on output from an electrostatic sensor, the Y signal control unit 52 sequentially specifies any of the strings 22 to specify an electrostatic sensor corresponding to the specified string. The X signal control unit 51 specifies any of the frets 23 to specify an electrostatic sensor corresponding to the specified fret. In this way, only the simultaneously specified electrostatic sensor of both the string 22 and the fret 23 is operated to output a change in an output value of the operated electrostatic sensor to the CPU 41 (refer to FIG. 2) as string-pressing position information.

Figure 4:
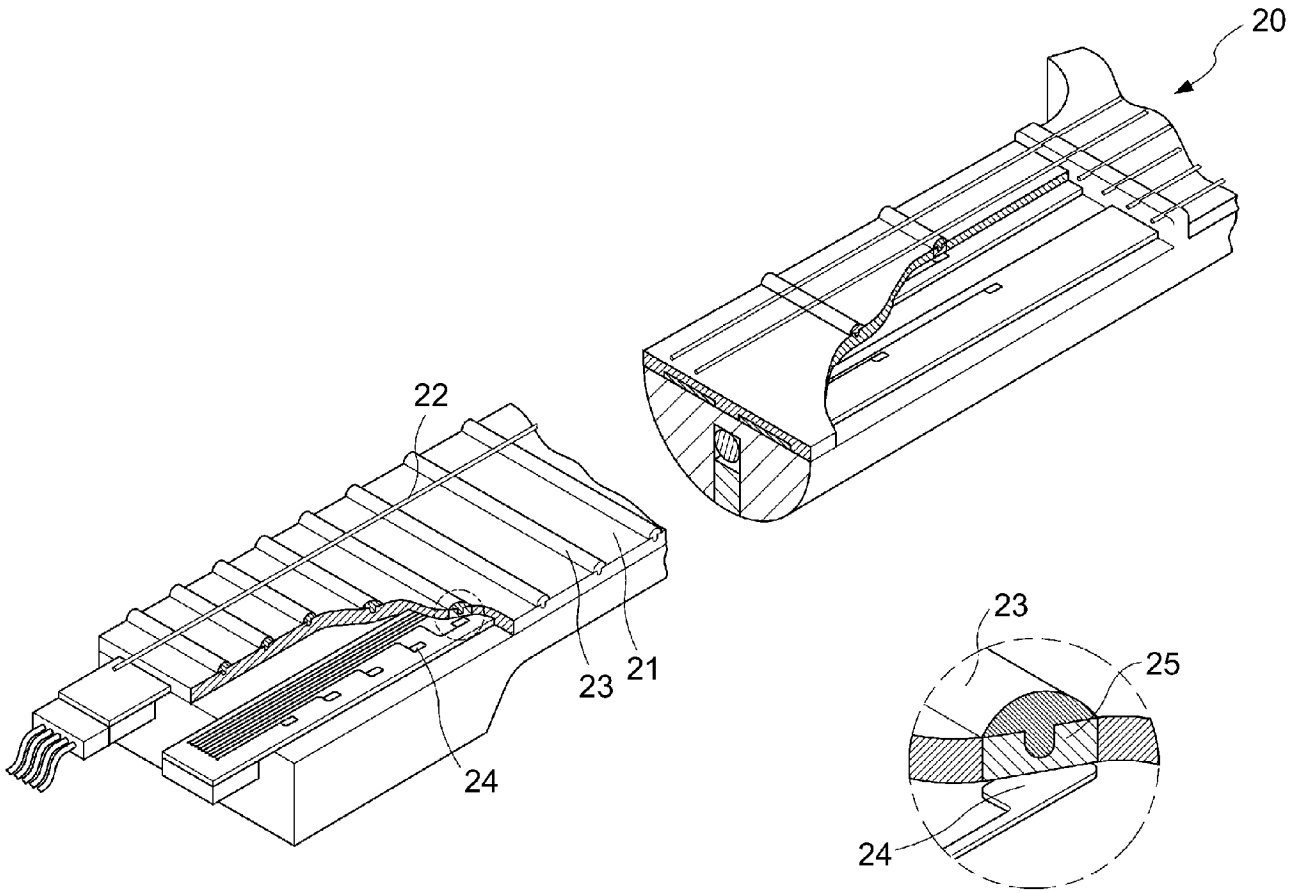
FIG. 4 is a perspective view of a neck applied with the type of string-pressing sensor for detecting electrical contact between a string and a fret.

FIG. 4 is a perspective view of the neck 20 applied with the type of string-pressing sensor 44 for detecting electrical contact of the string 22 with the fret 23.

In FIG. 4, an elastic electric conductor 25 is used to connect the fret 23 to a neck PCB (Poly Chlorinated Biphenyl) 24 arranged under the fingerboard 21. The fret 23 is electrically connected to the neck PCB 24 so as to detect conduction by contact of the string 22 with the fret 23, and a signal indicating what number of the string is in electrical contact with what number of the fret is sent to the CPU 41.

Figure 5:
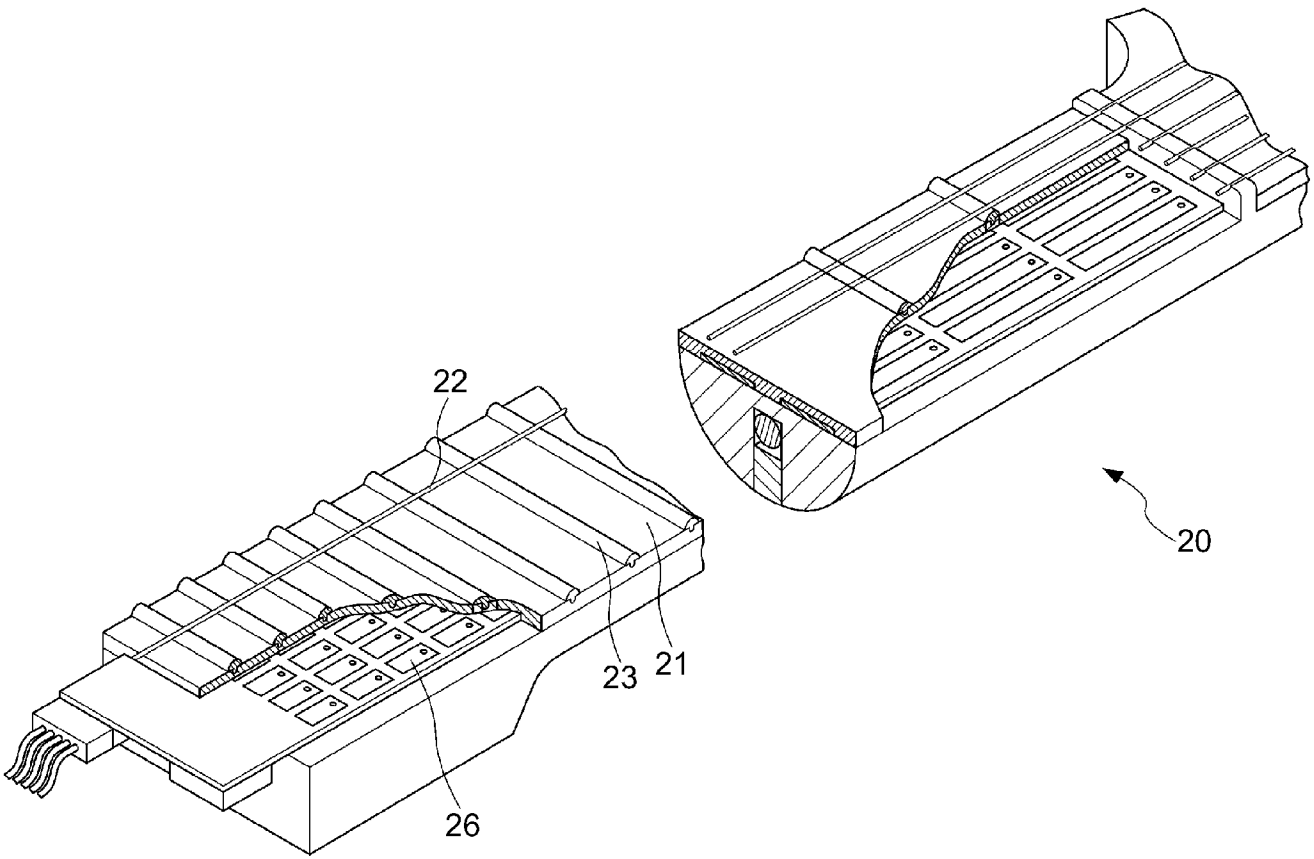
FIG. 5 is a perspective view of a neck applied with the type of a string-pressing sensor for detecting string-pressing without detecting contact of the string with the fret based on output from an electrostatic sensor.

FIG. 5 is a perspective view of the neck 20 applied with the type of the string-pressing sensor 44 for detecting string-pressing without detecting contact of the string 22 with the fret 23 based on output from an electrostatic sensor.

In FIG. 5, an electrostatic pad 26 as an electrostatic sensor is arranged under the fingerboard 21 in association with each of the strings 22 and each of the frets 23. That is, in the case of 6 strings×22 frets like the present embodiment, electrostatic pads are arranged in 144 locations. These electrostatic pads 26 detect electrostatic capacity when the string 22 approaches the fingerboard 21, and sends the electrostatic capacity to the CPU 41. The CPU 41 detects the string 22 and the fret 23 corresponding to a string-pressing position based on the sent value of the electrostatic capacity.

Main Flow

Figure 6:
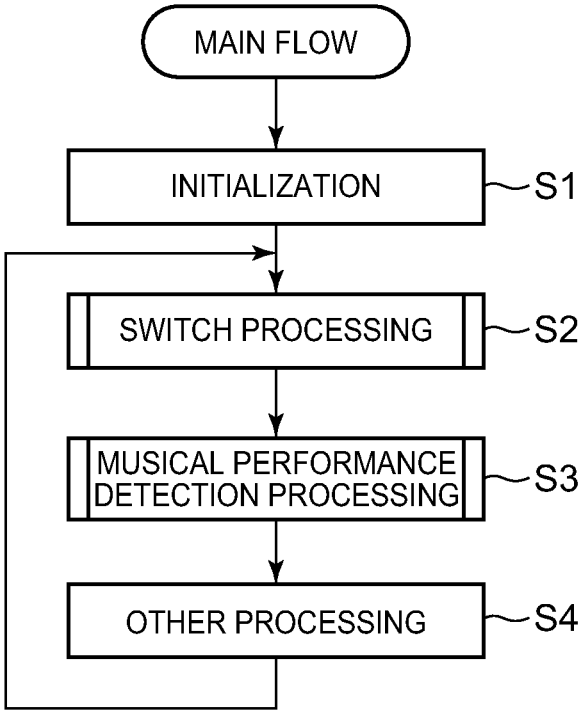
FIG. 6 is a flowchart showing a main flow executed in the musical sound control device according to the present embodiment.

FIG. 6 is a flowchart showing a main flow executed in the musical sound control device 1 according to the present embodiment.

Initially, in step S1, the CPU 41 is powered to be initialized. In step S2, the CPU 41 executes switch processing (described below in FIG. 7). In step S3, the CPU 41 executes musical performance detection processing (described below in FIG. 9). In step S4, the CPU 41 executes other processing. In the other processing, the CPU 41 executes, for example, processing for displaying a name of an output code on the display unit 15. After the processing of step S4 is finished, the CPU 41 advances processing to step S2 to repeat the processing of steps S2 up to S4.

Switch Processing

Figure 7:
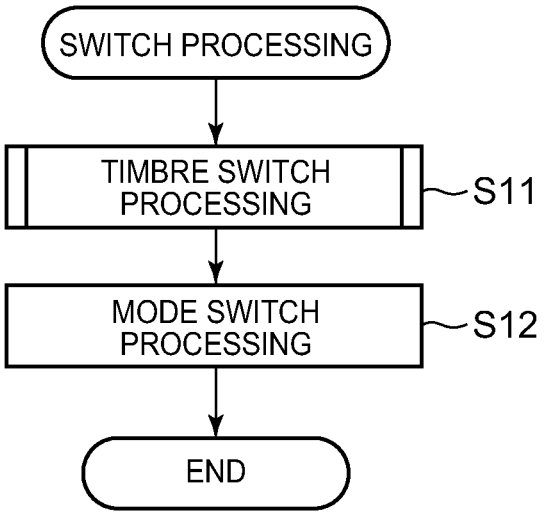
FIG. 7 is a flowchart showing switch processing executed in the musical sound control device according to the present embodiment.

FIG. 7 is a flowchart showing switch processing executed in the musical sound control device 1 according to the present embodiment.

Initially, in step S11, the CPU 41 executes timbre switch processing (described below in FIG. 8). In step S12, the CPU 41 executes mode switch processing. In the mode switch processing, the CPU 41 sets, in response to a signal from the switch 48, any mode of a mode of detecting a string-pressing position by detecting electrical contact of a string with a fret and a mode of detecting a string-pressing position by detecting contact of a string with a fret based on output from an electrostatic sensor. After the processing of step S12 is finished, the CPU 41 finishes the switch processing.

Timbre Switch Processing

Figure 8:
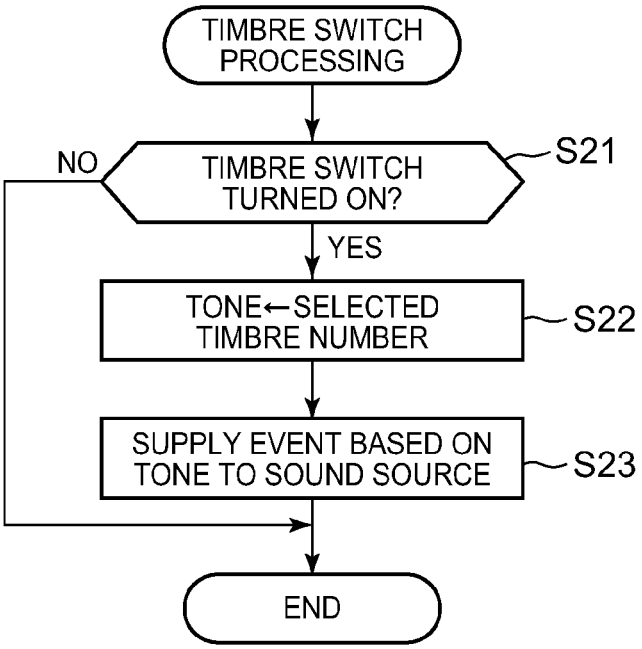
FIG. 8 is a flowchart showing timbre switch processing executed in the musical sound control device according to the present embodiment.

FIG. 8 is a flowchart showing timbre switch processing executed in the musical sound control device 1 according to the present embodiment.

Initially, in step S21, the CPU 41 determines whether or not a timbre switch (not shown in the drawing) is turned on. When it is determined that the timbre switch is turned on, the CPU 41 advances processing to step S22, and when it is determined that the switch is not turned on, the CPU 41 finishes the timbre switch processing. In step S22, the CPU 41 stores in a variable TONE a timbre number corresponding to timbre specified by the timbre switch. In step S23, the CPU 41 supplies an event based on the variable TONE to the sound source 45. Thereby, timbre to be generated is specified in the sound source 45. After the processing of step S23 is finished, the CPU 41 finishes the timbre switch processing.

Musical Performance Detection Processing

Figure 9:
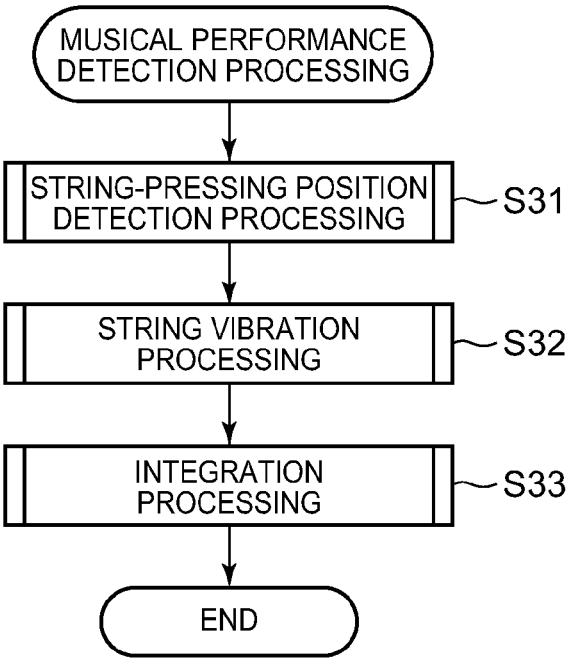
FIG. 9 is a flowchart showing musical performance detection processing executed in the musical sound control device according to the present embodiment.

FIG. 9 is a flowchart showing musical performance detection processing executed in the musical sound control device 1 according to the present embodiment.

Initially, in step S31, the CPU 41 executes string-pressing position detection processing (described below in FIG. 10). In step S32, the CPU 41 executes string vibration processing (described below in FIG. 16). In step S33, the CPU 41 executes integration processing (described below in FIG. 20). After the processing of step S33 is finished, the CPU 41 finishes the musical performance detection processing.

String-Pressing Position Detection Processing

Figure 10:
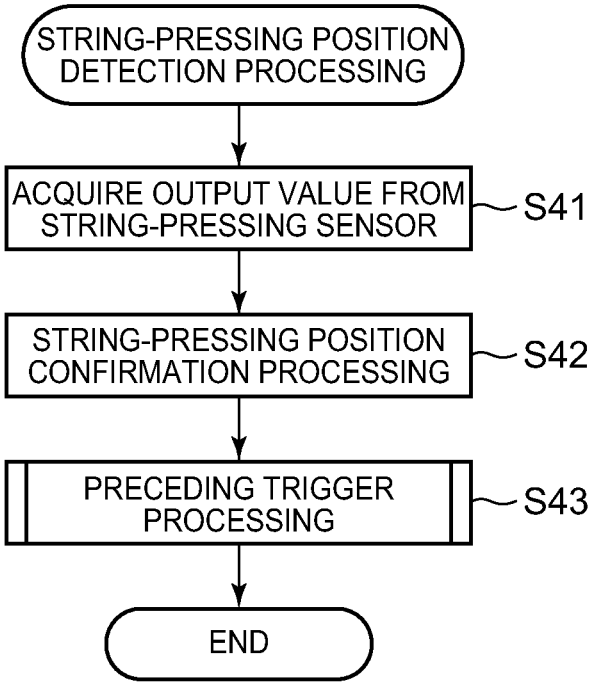
FIG. 10 is a flowchart showing string-pressing position detection processing executed in the musical sound control device according to the present embodiment.

FIG. 10 is a flowchart showing string-pressing position detection processing (processing of step S31 in FIG. 11) executed in the musical sound control device 1 according to the present embodiment. The string-pressing position detection processing is processing for detecting electrical contact of a string with a fret.

Initially, in step S41, the CPU 41 acquires an output value from the string-pressing sensor 44. In a case of the type of the string-pressing sensor 44 for detecting electrical contact of the string 22 with the fret 23, the CPU 41 receives, as an output value of the string-pressing sensor 44, a fret number of the fret 23 in electrical contact with each of the strings 22 together with the number of the string in contact therewith. In a case of the type of the string-pressing sensor 44 for detecting contact of the string 22 with the fret 23 based on output from an electrostatic sensor, the CPU 41 receives, as an output value of the string-pressing sensor 44, the value of electrostatic capacity corresponding to a string number and a fret number. Additionally, the CPU 41 determines, in a case where the received value of electrostatic capacity corresponding to a string number and a fret number exceeds a predetermined threshold, that a string is pressed in an area corresponding to the string number and the fret number.

In step S42, the CPU 41 executes processing for confirming a string-pressing position. Specifically, the CPU 41 determines that a string is pressed with respect to the fret 23 corresponding to the highest fret number among a plurality of frets 23 corresponding to each of the pressed strings 22.

In step S43, the CPU 41 executes preceding trigger processing (described below in FIG. 11). After the processing of step S43 is finished, the CPU 41 finishes the string-pressing position detection processing.

Preceding Trigger Processing

Figure 11:
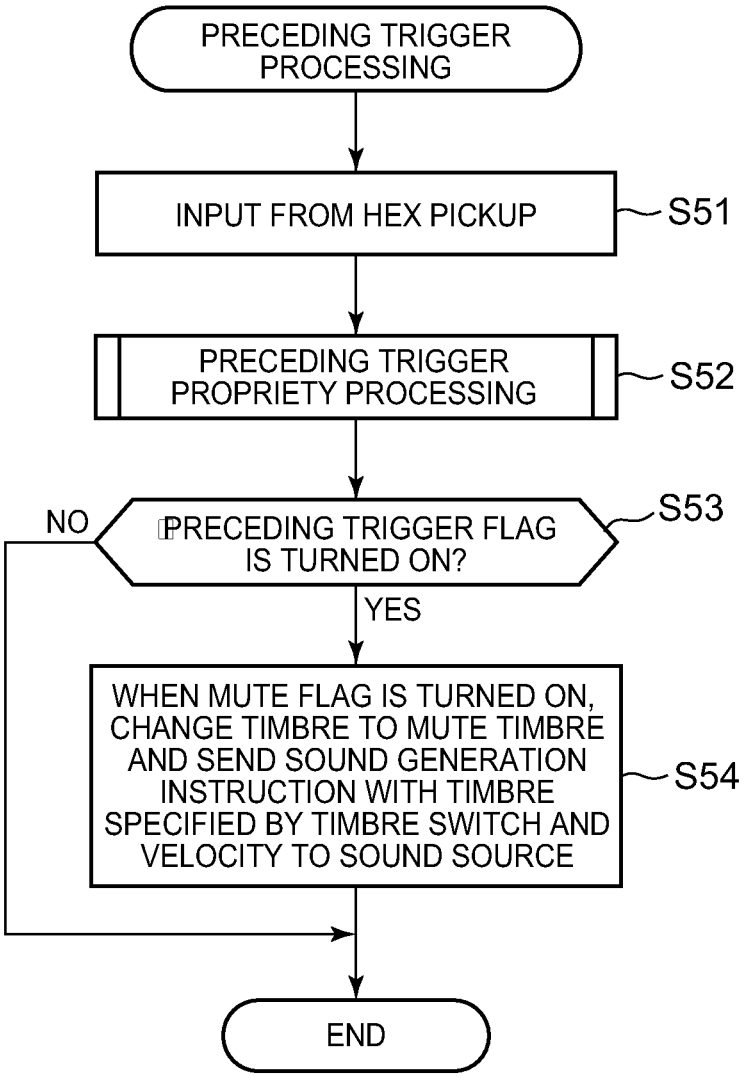
FIG. 11 is a flowchart showing preceding trigger processing executed in the musical sound control device according to the present embodiment.

FIG. 11 is a flowchart showing preceding trigger processing (processing of step S43 in FIG. 10) executed in the musical sound control device 1 according to the present embodiment. Here, preceding trigger is trigger to generate sound at timing at which string-pressing is detected prior to string picking by a player.

Initially, in step S51, the CPU 41 receives output from the hex pickup 12 to acquire a vibration level of each string. In step S52, the CPU 41 executes preceding trigger propriety processing (described below in FIG. 12). In step S53, it is determined whether or not preceding trigger is feasible, that is, a preceding trigger flag is turned on. The preceding trigger flag is turned on in step S62 of preceding trigger propriety processing described below. In a case where the preceding trigger flag is turned on, the CPU 41 advances processing to step S54, and in a case where the preceding trigger flag is turned off, the CPU 41 finishes the preceding trigger processing.

In step S54, the CPU 41 sends a signal of a sound generation instruction to the sound source 45 based on timbre specified by a timbre switch and velocity decided in step S63 of preceding trigger propriety processing. At the time, in a case where a mute flag described below is turned on with reference to FIG. 14, the CPU 41 changes timbre to be a mute timbre having a frequency characteristic with a less high frequency component, and sends a signal of a sound generation instruction to the sound source 45. After the processing of step S54 is finished, the CPU 41 finishes the preceding trigger processing.

Preceding Trigger Propriety Processing

Figure 12:
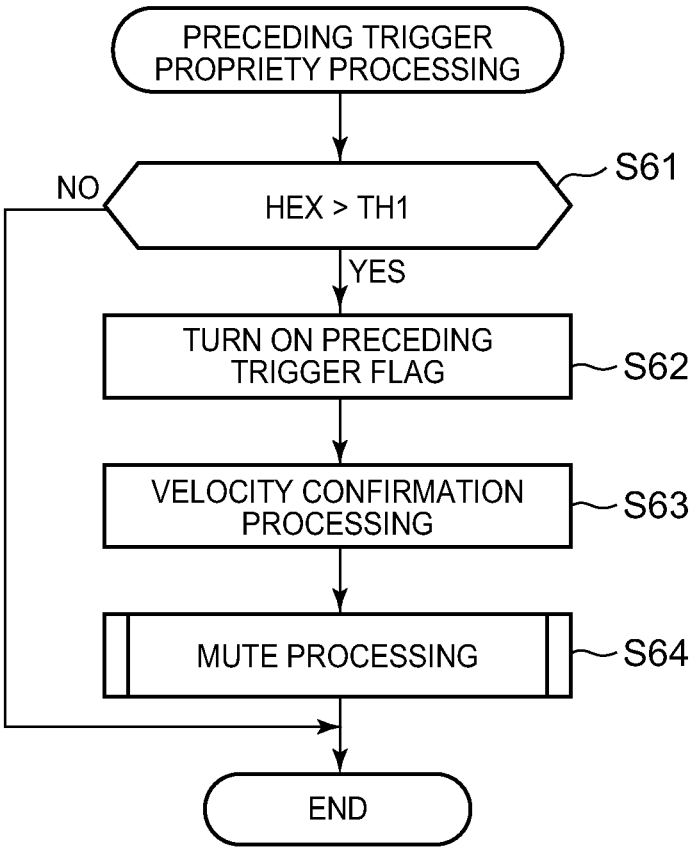
FIG. 12 is a flowchart showing preceding trigger propriety processing executed in the musical sound control device according to the present embodiment.

FIG. 12 is a flowchart showing preceding trigger propriety processing (processing of step S52 in FIG. 11) executed in the musical sound control device 1 according to the present embodiment.

Initially, in step S61, the CPU 41 determines whether or not a vibration level of each string based on output from the hex pickup 12 received in step S51 in FIG. 11 is larger than a predetermined threshold (Th1). In a case where determination is YES in this step, the CPU 41 advances processing to step S62, and in a case of NO in this step, the CPU 41 finishes the preceding trigger propriety processing.

In step S62, the CPU 41 turns on the preceding trigger flag to allow preceding trigger. In step S63, the CPU 41 executes velocity confirmation processing.

Specifically, in the velocity confirmation processing, the following processing is executed. The CPU 41 detects acceleration of a change of a vibration level based on sampling data of three vibration levels prior to the point when a vibration level based on output of a hex pickup exceeds Th1 (referred to below as "Th1 point"). Specifically, first velocity of a change of a vibration level based on first and second preceding sampling data from the Th1 point. Further, second velocity of a change of a vibration level based on second and third preceding sampling data from the Th1 point. Then, acceleration of a change of a vibration level is detected based on the first velocity and the second velocity. Additionally, the CPU 41 applies interpolation so that velocity falls into a range from 0 to 127 in dynamics of acceleration obtained in an experiment.

Specifically, where velocity is "VEL", the detected acceleration is "K", dynamics of acceleration obtained in an experiment are "D" and a correction value is "H", velocity is calculated by the following expression (1).

$$VEL=(K/D)\times 128\times H \quad (1)$$

Data of a map (not shown in the drawing) indicating a relationship between the acceleration K and the correction value H is stored in the ROM 42 for every one of pitch of respective strings. In a case of observing a waveform of certain pitch of a certain string, there is a unique characteristic in a change of the waveform immediately after the string is distanced from a pick. Therefore, data of a map of the characteristic is stored in the ROM 42 beforehand for every one of pitch of respective strings so that the correction value H is acquired based on the detected acceleration K.

In step S64, the CPU 41 executes mute detection processing (described below in FIGS. 13 to 15). After the processing of step S64 is finished, the CPU 41 finishes the preceding trigger propriety processing.

Mute Processing

Figure 13:
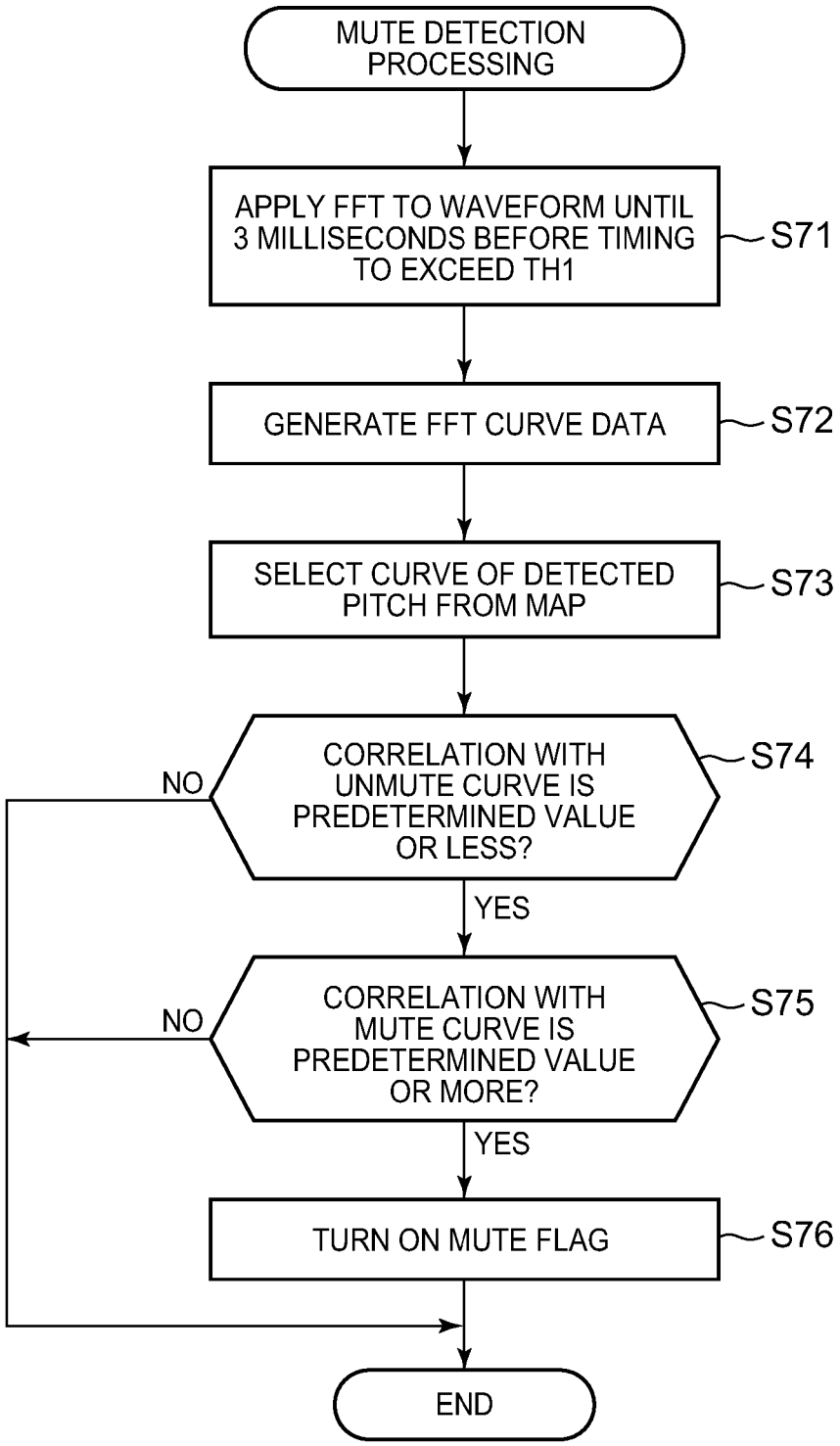
FIG. 13 is a flowchart showing mute detection processing executed in the musical sound control device according to the present embodiment.

FIG. 13 is a flowchart showing mute processing (processing of step S64 in FIG. 12) executed in the musical sound control device 1 according to the present embodiment.

Initially, in step S71, a waveform is subjected to FFT (Fast Fourier Transform) based on a vibration level of each string based on output from the hex pickup 12 that is received in step S51 in FIG. 11, until 3 milliseconds before timing at which the vibration level exceeds a predetermined threshold (Th1). In step S72, FFT curve data is generated based on the waveform subjected to FFT.

In step S73, data of a curve of pitch corresponding to the string-pressing position decided in step S42 in FIG. 10 is selected from map data stored beforehand in the ROM 42 for unmuting and muting. A description is given for the map data with reference to FIG. 21 and FIG. 22.

Figure 21:
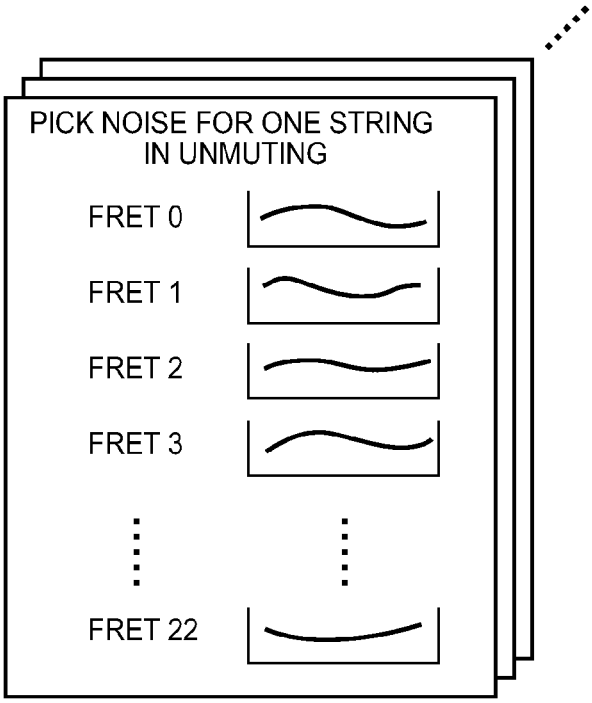
FIG. 21 is a diagram showing a map of an FFT curve of a pick noise in unmuting.

FIG. 21 is a diagram showing a map of an FFT curve of a pick noise in unmuting. Map data of an FFT curve of a pick noise in unmuting is stored in the ROM 42 in association with pitch for every one of 22 frets of respective 6 strings.

Figure 22:
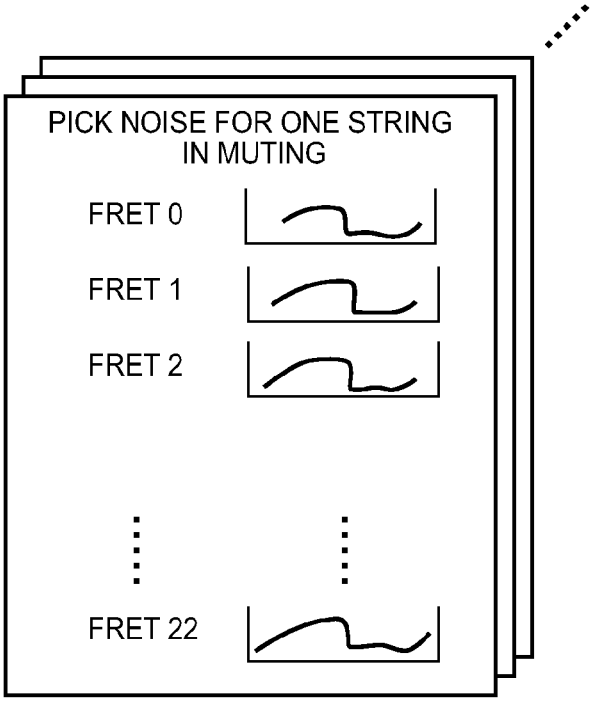
FIG. 22 is a diagram showing a map of an FFT curve of a pick noise in muting.

Additionally, FIG. 22 is a diagram showing a map of an FFT curve of a pick noise in muting. Map data of an FFT curve of a pick noise in muting is stored in the ROM 42 in association with pitch for every one of 22 frets of respective 6 strings.

Returning to FIG. 13, in step S74, the CPU 41 compares the data of the FFT curve generated in step S72 to the data of the FFT curve in unmuting that is selected in step S73, to determine whether or not the value indicating correlation is a predetermined value or less. Here, correlation represents the degree of approximation between two FFT curves. Therefore, the more approximate two FFT curves are, the larger the value indicating correlation is. In a case where it is determined in step S74 that the value indicating correlation is a predetermined value or less, it is determined that unmuting is not performed (that is, muting is possibly performed), and the CPU 41 advances processing to step S75. On the other hand, in a case where it is determined that the value indicating correlation is larger than a predetermined value, it is determined that unmuting is most likely to be performed, and the CPU 41 finishes the mute processing.

In step S75, the CPU 41 compares the data of the FFT curve generated in step S72 to the data of the FFT curve in muting that is selected in step S73, to determine whether or not the value indicating correlation is a predetermined value or more. In a case where it is determined that the value indicating correlation is a predetermined value or more, it is determined that muting is performed, and the CPU 41 advances processing to step S76. In step S76, the CPU 41 turns on a mute flag. On the other hand, in a case where it is determined in step S75 that the value indicating correlation is less than a predetermined value, it is determined that muting is not performed, and the CPU 41 finishes the mute processing.

Mute Processing (First Variation)

Figure 14:
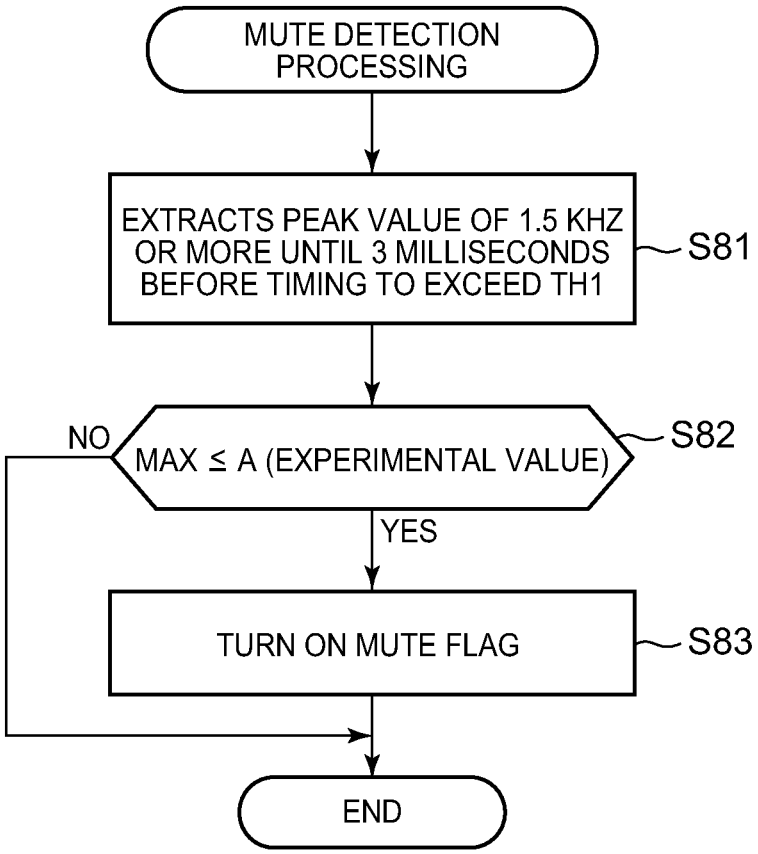
FIG. 14 is a flowchart showing a first variation of mute detection processing executed in the musical sound control device according to the present embodiment.

FIG. 14 is a flowchart showing a first variation of mute processing (processing of step S64 in FIG. 12) executed in the musical sound control device 1 according to the present embodiment.

Initially, in step S81, a peak value corresponding to a frequency of 1.5 KHz or more is extracted among peak values based on a vibration level of each string based on output from the hex pickup 12 that is received in step S51 in FIG. 11, until 3 milliseconds before timing at which the vibration level exceeds a predetermined threshold (Th1). In a case where a maximum value of the peak value extracted in step S81 is a threshold A that is obtained in an experiment in step S82 or less, the CPU 41 turns on a mute flag in step S83. After the processing of step S83 is finished, the CPU 41 finishes the mute processing. In a case where the maximum value is larger than the threshold A in step S82, the CPU 41 finishes the mute processing.

Mute Processing (Second Variation)

Figure 15:
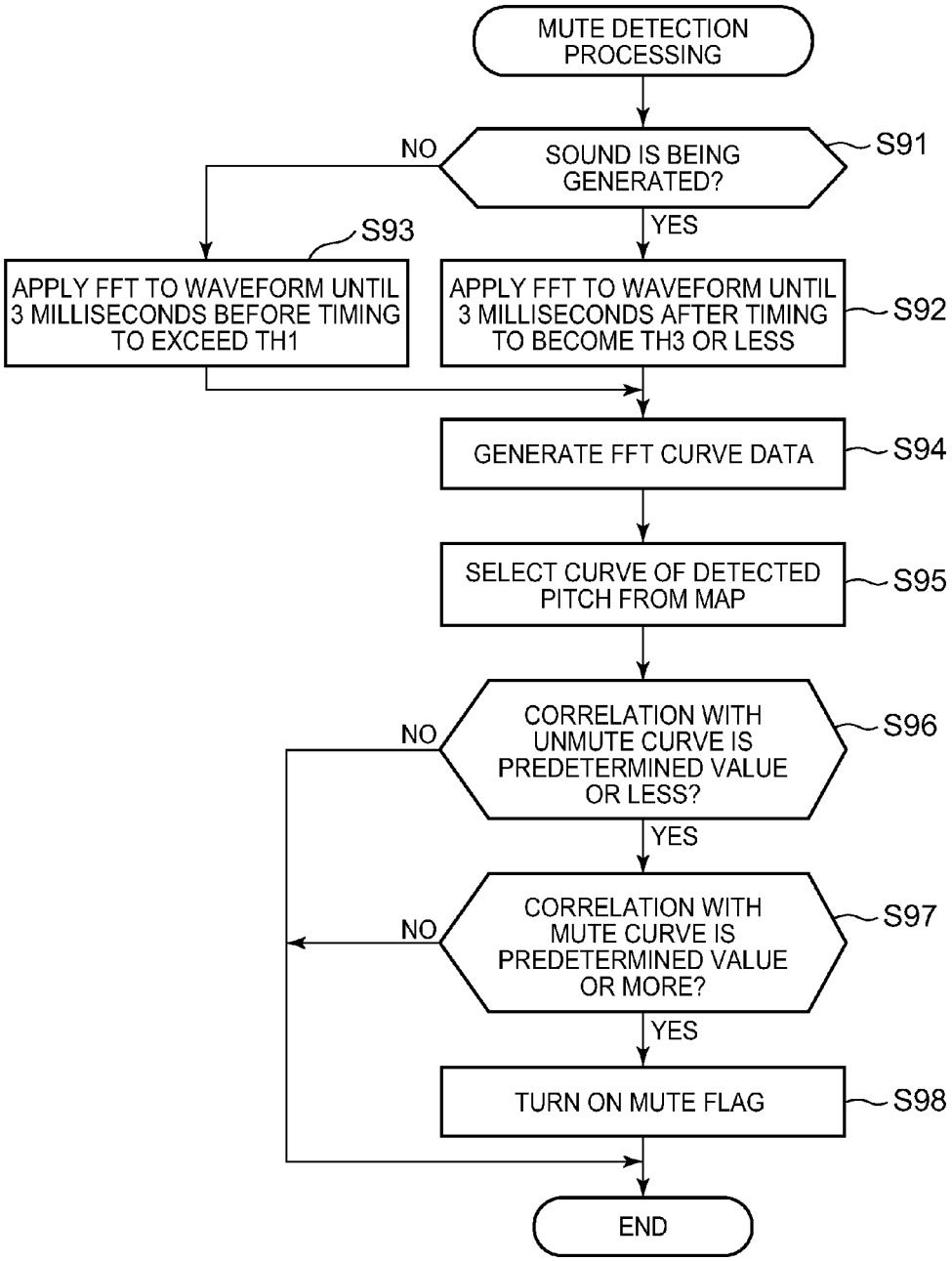
FIG. 15 is a flowchart showing a second variation of mute detection processing executed in the musical sound control device according to the present embodiment.

FIG. 15 is a flowchart showing a second variation of mute processing (processing of step S64 in FIG. 12) executed in the musical sound control device 1 according to the present embodiment.

Initially, in step S91, the CPU 41 determines whether or not sound is being generated. In a case where sound is being generated, in step S92, the CPU 41 applies FFT (Fast Fourier Transform) to a waveform based on a vibration level of each string based on output from the hex pickup 12 that is received in step S51 in FIG. 11, until 3 milliseconds after timing at which the vibration level becomes a predetermined level (Th3) or less (sound muting timing). On the other hand, in a case where sound is not being generated, in step S92, the CPU 41 applies FFT (Fast Fourier Transform) to a waveform based on a vibration level of each string based on output from the hex pickup 12 that is received in step S51 in FIG. 11, until 3 milliseconds before timing at which the vibration level exceeds a predetermined threshold (Th1). Subsequent processing of steps S94 up to S98 is the same as the processing of steps S72 up to S76 in FIG. 13.

String Vibration Processing

Figure 16:
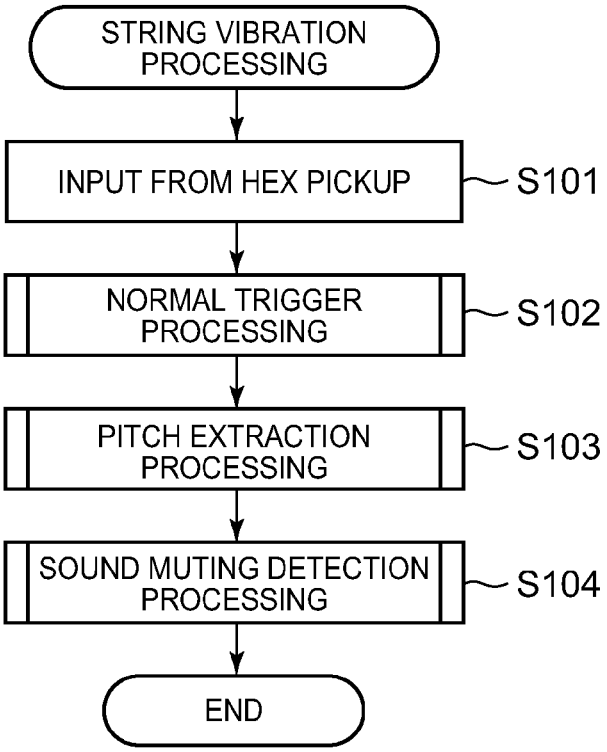
FIG. 16 is a flowchart showing string vibration processing executed in the musical sound control device according to the present embodiment.

FIG. 16 is a flowchart showing string vibration processing (processing of step S32 in FIG. 9) executed in the musical sound control device 1 according to the present embodiment.

Initially, in step S101, the CPU 41 receives output from the hex pickup 12 to acquire a vibration level of each string. In step S102, the CPU 41 executes normal trigger processing (described below in FIG. 17). In step S103, the CPU 41 executes pitch extraction processing (described below in FIG. 18). In step S104, the CPU 41 executes sound muting detection processing (described below in FIG. 19). After the processing of step S104 is finished, the CPU 41 finishes the string vibration processing.

Normal Trigger Processing

Figure 17:
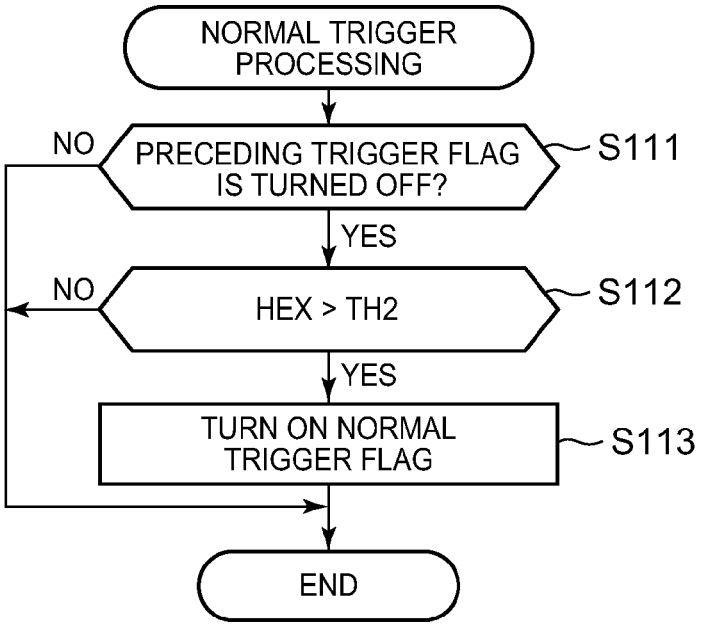
FIG. 17 is a flowchart showing normal trigger processing executed in the musical sound control device according to the present embodiment.

FIG. 17 is a flowchart showing normal trigger processing (processing of step S102 in FIG. 16) executed in the musical sound control device 1 according to the present embodiment. Normal trigger is trigger to generate sound at timing at which string picking by a player is detected.

Initially, in step S111, the CPU 41 determines whether preceding trigger is not allowed. That is, the CPU 41 determines whether or not a preceding trigger flag is turned off. In a case where it is determined that preceding trigger is not allowed, the CPU 41 advances processing to step S112. In a case where it is determined that preceding trigger is allowed, the CPU 41 finishes the normal trigger processing. In step S112, the CPU 41 determines whether or not a vibration level of each string based on output from the hex pickup 12 that is received in step S101 in FIG. 16 is larger than a predetermined threshold (Th2). In a case where determination is YES in this step, the CPU 41 advances processing to step S113, and in a case of NO in this step, the CPU 41 finishes the normal trigger processing. In step S113, the CPU 41 turns on a normal trigger flag so as to allow normal trigger. After processing of step S113 is finished, the CPU 41 finishes the normal trigger processing.

Pitch Extraction Processing

Figure 18:
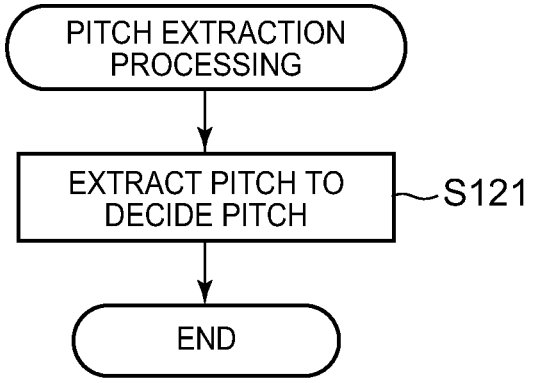
FIG. 18 is a flowchart showing pitch extraction processing executed in the musical sound control device according to the present embodiment.

FIG. 18 is a flowchart showing pitch extraction processing (processing of step S103 in FIG. 16) executed in the musical sound control device 1 according to the present embodiment.

In step S121, the CPU 41 extracts pitch by means of known art to decide pitch. Here, the known art includes, for example, a technique described in Japanese Unexamined Patent Application, Publication No. H1-177082.

Sound Muting Detection Processing

Figure 19:
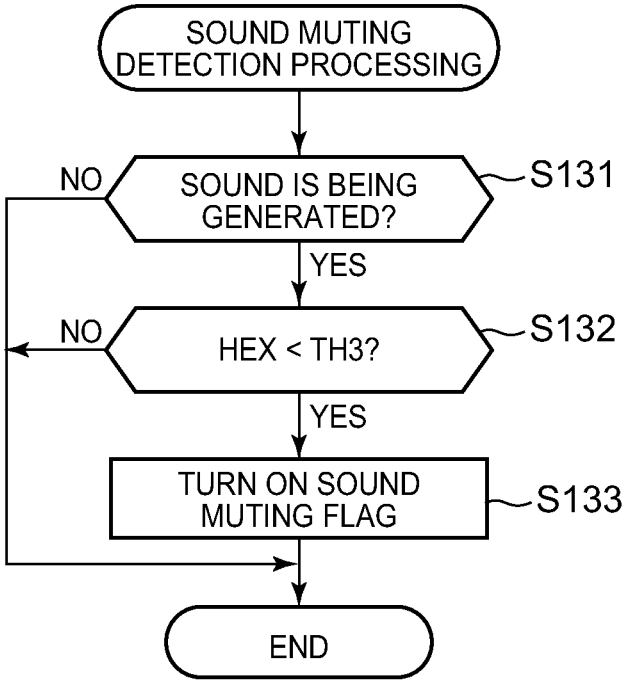
FIG. 19 is a flowchart showing sound muting detection processing executed in the musical sound control device according to the present embodiment.

FIG. 19 is a flowchart showing sound muting detection processing (processing of step S104 in FIG. 16) executed in the musical sound control device 1 according to the present embodiment.

Initially, in step S131, the CPU 41 determines whether or not the sound is being generated. In a case where determination is YES in this step, the CPU 41 advances processing to step S132, and in a case where determination is NO in this step, the CPU 41 finishes the sound muting detection processing. In step S132, the CPU 41 determines whether or not a vibration level of each string based on output from the hex pickup 12 that is received in step S101 in FIG. 16 is smaller than a predetermined threshold (Th3). In a case where determination is YES in this step, the CPU 41 advances processing to step S133, and in a case of NO in this step, the CPU 41 finishes the sound muting detection processing. In step S133, the CPU 41 turns on a sound muting flag. After the processing of step S133 is finished, the CPU 41 finishes the sound muting detection processing.

Integration Processing

Figure 20:
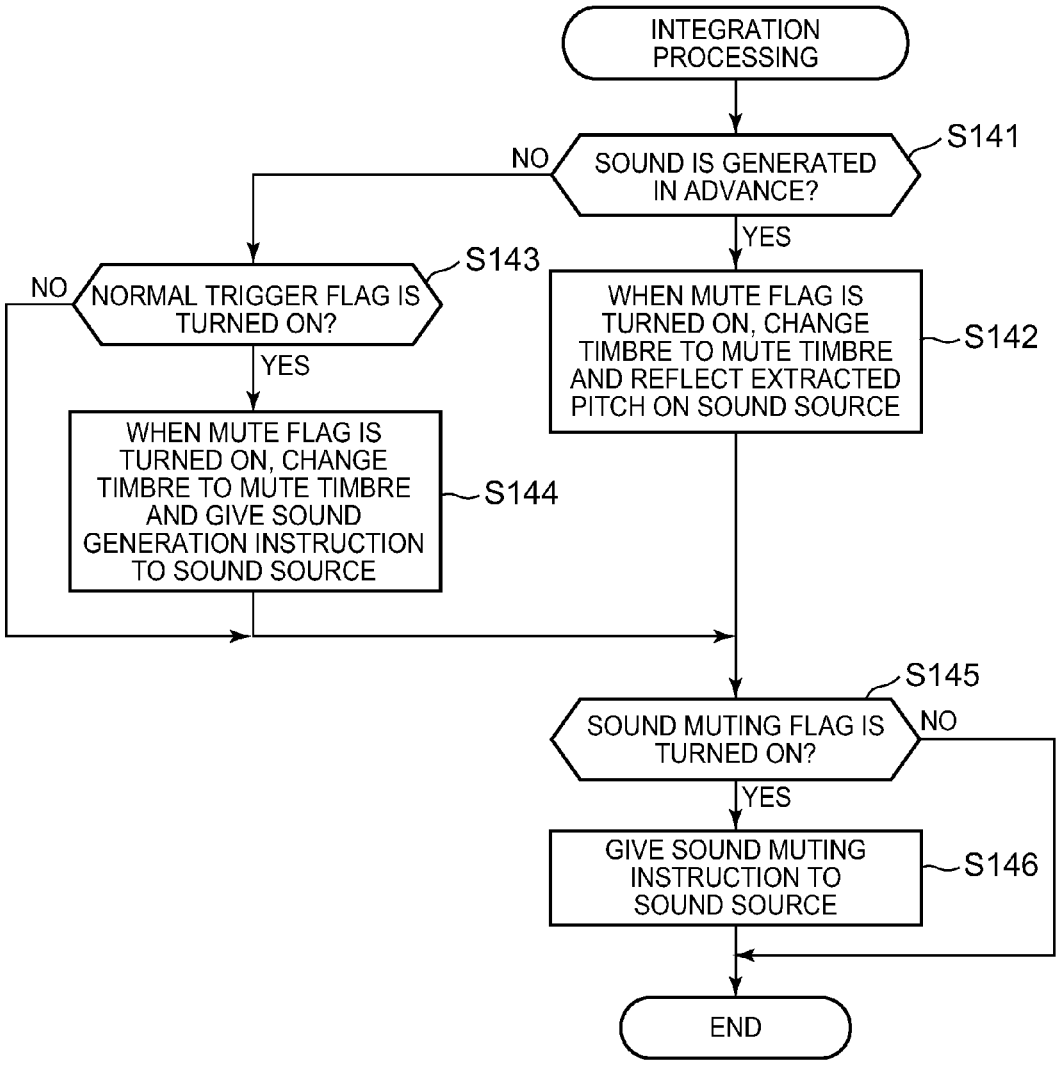
FIG. 20 is a flowchart showing integration processing executed in the musical sound control device according to the present embodiment.

FIG. 20 is a flowchart showing integration processing (processing of step S33 in FIG. 9) executed in the musical sound control device 1 according to the present embodiment. In the integration processing, the result of the string-pressing position detection processing (processing of step S31 in FIG. 9) and the result of the string vibration processing (processing of step S32 in FIG. 9) are integrated.

Initially, in step S141, the CPU 41 determines whether or not sound is generated in advance. That is, in the preceding trigger processing (refer to FIG. 11), it is determined whether or not a sound generation instruction is given to the sound source 45. In a case where the sound generation instruction is given to the sound source 45 in the preceding trigger processing, the CPU 41 advances processing to step S142. In step S142, data of pitch extracted in the pitch extraction processing (refer to FIG. 18) is sent to the sound source 45, thereby correcting pitch of a musical sound generated in advance in the preceding trigger processing. At the time, in a case where a mute flag is turned on, the CPU 41 changes timbre to mute timbre to send data of the timbre to the sound source 45. After the processing of step S54 is finished, the CPU 41 finishes the preceding trigger processing. Thereafter, the CPU 41 advances processing to step S145.

On the other hand, in a case where it is determined in step S141 that a sound generation instruction is not given to the sound source 45 in the preceding trigger processing, the CPU 41 advances processing to step S143. In step S143, the CPU 41 determines whether or not a normal trigger flag is turned on. In a case where the normal trigger flag is turned on, the CPU 41 sends a sound generation instruction signal to the sound source 45 in step S144. At the time, in a case where a mute flag is turned on, the CPU 41 changes timbre to mute timbre to send data of the timbre to the sound source 45. Thereafter, the CPU 41 advances processing to step S145. In a case where a normal trigger flag is turned off in step S143, the CPU 41 advances processing to step S145.

In step S145, the CPU 41 determines whether or not a sound muting flag is turned on. In a case where the sound muting flag is turned on, the CPU 41 sends a sound muting instruction signal to the sound source 45 in step S146. In a case where the sound muting flag is turned off, the CPU 41 finishes the integration processing. After the processing of step S146 is finished, the CPU 41 finishes the integration processing.

A description has been given above concerning the configuration and processing of the musical sound control device 1 of the present embodiment.

In the present embodiment, the CPU 41 acquires a string vibration signal in a case where a string picking operation is performed with respect to the stretched string 22, analyzes a frequency characteristic of the acquired string vibration signal, determines whether or not the analyzed frequency characteristic satisfies a predetermined condition, and changes a frequency characteristic of a musical sound generated in the connected sound source 45 depending on a case where it is determined that the predetermined condition is satisfied or determined that the predetermined condition is not satisfied.

Therefore, in a case where the predetermined condition is satisfied, it is possible to realize generation of a musical sound having a frequency characteristic with a less high frequency component of muting or the like by changing a frequency characteristic of a musical sound.

Further, in the present embodiment, the CPU 41 makes a change, in a case where it is determined that the predetermined condition is satisfied, into a musical sound having a frequency characteristic with a less high frequency component compared to a case where it is determined that the predetermined condition is not satisfied.

Therefore, in a case where the predetermined condition is satisfied, it is possible to realize generation of a musical sound having a frequency characteristic with a less high frequency component of muting or the like.

Additionally, in the present embodiment, the CPU 41 determines that the predetermined condition is satisfied in a case where there is correlation at a certain level or above between a predetermined frequency characteristic model prepared beforehand and the analyzed frequency characteristic.

Therefore, it is possible to easily realize muting by appropriately setting a predetermined condition.

Moreover, in the present embodiment, the CPU 41 extracts a frequency component in a predesignated part of the acquired string vibration signal to determine that the predetermined condition is satisfied in a case where the extracted frequency component includes a specific frequency component.

Therefore, it is possible to easily realize muting by appropriately setting a predetermined condition.

Further, in the present embodiment, the CPU 41 extracts a frequency component in an interval from a vibration start time of the acquired string vibration signal to before a predetermined time.

Therefore, it is possible to determine whether or not muting is performed before a musical sound is first generated.

Furthermore, in the present embodiment, the CPU 41 extracts a frequency component in an interval from a vibration end time of the acquired string vibration signal to an elapsed predetermined time.

Therefore, in a case where sound is being successively generated during musical performance, it is possible to determine whether or not muting is performed immediately after a musical sound being generated is muted and until a next musical sound is generated.

A description has been given above concerning embodiments of the present invention, but these embodiments are merely examples and are not intended to limit the technical scope of the present invention. The present invention can have various other embodiments, and in addition various types of modification such as abbreviations or substitutions can be made within a range that does not depart from the scope of the invention. These embodiments or modifications are included in the range and scope of the invention described in the present specification and the like, and are included in the invention and an equivalent range thereof described in the scope of the claims.

What is claimed is:

1. A musical sound control device, comprising:

an acquisition unit that acquires a string vibration signal in a case in which a string picking operation is performed with respect to a stretched string;

an extraction unit that extracts a frequency component within a specific frequency in a predesignated part of the string vibration signal acquired by the acquisition unit;

an analysis unit that analyzes a frequency characteristic of the frequency component extracted by the extraction unit;

a determination unit that determines whether a condition is satisfied such that a value, which indicates a degree to which a frequency characteristic of a pick noise in a mute playing style prepared beforehand is correlated with the frequency characteristic analyzed by the analysis unit, is a predetermined value or above; and a change unit that changes a musical sound having a frequency characteristic such that (i) in a case in which the determination unit determines that the condition is satisfied, the frequency characteristic has a first high frequency component that is less than a second high frequency component, and (ii) in a case in which the determination unit determines that the condition is not satisfied, the frequency characteristic has the second high frequency component.

2. The musical sound control device according to claim 1, wherein the extraction unit extracts the frequency component in an interval from a vibration start time of the acquired string vibration signal to before a predetermined time.

3. The musical sound control device according to claim 1, wherein the extraction unit extracts the frequency component in an interval from a vibration end time of the acquired string vibration signal to an elapsed predetermined time.

4. A musical sound control method for a musical sound control device including a processor that acquires a string vibration signal in a case in which a string picking operation is performed with respect to a stretched string, the method comprising:

extracting, with the processor, a frequency component within a specific frequency in a predesignated part of the acquired string vibration signal;

analyzing, with the processor, a frequency characteristic of the extracted frequency component;

determining, with the processor, whether a condition is satisfied such that a value, which indicates a degree to which a frequency characteristic of a pick noise in a mute playing style prepared beforehand is correlated with the analyzed frequency characteristic, is a predetermined value or above; and changing, with the processor, a musical sound having a frequency characteristic such that (i) in a case in which it is determined that the condition is satisfied, the frequency characteristic has a first high frequency component that is less than a second high frequency component, and (ii) in a case in which it is determined that the condition is not satisfied, the frequency characteristic has the second high frequency component.

5. The musical sound control method according to claim 4, wherein the extracting comprises extracting, with the processor, the frequency component in an interval from a vibration start time of the acquired string vibration signal to before a predetermined time.

6. The musical sound control method according to claim 4, wherein the extracting comprises extracting, with the processor, the frequency component in an interval from a vibration end time of the acquired string vibration signal to an elapsed predetermined time.

7. A non-transitory computer-readable storage medium having stored thereon instructions that are executable by a computer of a musical sound control device that acquires a string vibration signal in a case in which a string picking operation is performed with respect to a stretched string, the instructions being executable by the computer to perform functions comprising:

extracting a frequency component within a specific frequency in a predesignated part of the acquired string vibration signal;

analyzing a frequency characteristic of the extracted frequency component;

determining whether a condition is satisfied such that a value, which indicates a degree to which a frequency characteristic of a pick noise in a mute playing style prepared beforehand is correlated with the analyzed frequency characteristic, is a predetermined value or above; and changing a musical sound having a frequency characteristic such that (i) in a case in which it is determined that the condition is satisfied, the frequency characteristic has a first high frequency component that is less than a second high frequency component, and (ii) in a case in which it is determined that the condition is not satisfied, the frequency characteristic has the second high frequency component.

8. The non-transitory storage medium according to claim 7, wherein the extracting comprises extracting the frequency component in an interval from a vibration start time of the acquired string vibration signal to before a predetermined time.

9. The non-transitory storage medium according to claim 7, wherein the extracting comprises extracting the frequency component in an interval from a vibration end time of the acquired string vibration signal to an elapsed predetermined time.

* * * * *